US012312733B1

(12) United States Patent
Hiatt

(10) Patent No.: US 12,312,733 B1
(45) Date of Patent: May 27, 2025

(54) COLLAPSIBLE STAND ASSEMBLY FOR DRYING AND STORAGE

(71) Applicant: The Drying Tree, LLC, Sachse, TX (US)

(72) Inventor: Jerremy Samuel Hiatt, Sachse, TX (US)

(73) Assignee: The Drying Tree, LLC, Sachse, TX (US)

( * ) Notice: Subject to any disclaimer, the term of this patent is extended or adjusted under 35 U.S.C. 154(b) by 0 days.

(21) Appl. No.: 18/660,099

(22) Filed: May 9, 2024

(51) Int. Cl.
*D06F 57/04* (2006.01)
*D06F 57/08* (2006.01)

(52) U.S. Cl.
CPC ..... *D06F 57/04* (2013.01); *D06F 57/08* (2013.01)

(58) Field of Classification Search
CPC ..... A47F 5/02; A47F 5/04; A47F 5/06; A47G 25/0664; A47G 25/0685; A47G 25/0671; D06F 57/04; D06F 57/08; D06F 57/10; A45B 23/00; A45B 2023/0012
USPC ..... 211/167, 197, 196, 166, 205, 107, 203, 211/85.24; 248/168, 169, 434
See application file for complete search history.

(56) References Cited

U.S. PATENT DOCUMENTS 140,193 A * 6/1873 Graves ..... D06F 57/04 211/167
146,308 A * 1/1874 Boorn ..... D06F 57/04 211/197
606,401 A * 6/1898 Williston ..... A47F 5/02 211/171
617,611 A * 1/1899 Strickland ..... D06F 57/04 211/171
883,162 A * 3/1908 Baecker ..... A47F 5/04 211/115
1,259,623 A * 3/1918 Herrick ..... A47F 5/02 211/70.6
1,344,660 A * 6/1920 Stevenson ..... D06F 57/12 211/171
1,525,701 A * 2/1925 Rose ..... A47G 25/0664 211/196
1,713,673 A * 5/1929 Nelson ..... D06F 57/04 248/173
1,862,644 A * 6/1932 Wieneke ..... D06F 57/04 211/167
1,883,435 A * 10/1932 Zifferer ..... A47B 61/003 211/167
2,022,712 A * 12/1935 Firle ..... D06F 57/04 211/163
2,259,390 A * 10/1941 Monckmeier ..... D06F 57/04 211/171
2,794,556 A * 6/1957 Lego ..... D06F 57/04 211/167
3,038,690 A * 6/1962 Alexiou ..... A47C 9/105 248/155.3

(Continued)

*Primary Examiner* — Jennifer E. Novosad
(74) *Attorney, Agent, or Firm* — Ashek M. Rahman

(57) ABSTRACT

A collapsible stand assembly for drying and storage includes an upper assembly and a lower assembly. The upper assembly is configured to be stacked above the lower assembly. A plurality of first arms extend outward from an upper frame of the upper assembly, and a plurality of second arms extend outward from a lower frame of the lower assembly. A plurality of legs extend outward from the lower frame of the lower assembly. The first and second arms and the legs are collapsible into a compact configuration.

18 Claims, 5 Drawing Sheets

(56) References Cited

U.S. PATENT DOCUMENTS 3,464,664 A * 9/1969 Nugent ..... F16M 11/242 211/172
D294,758 S * 3/1988 Meade ..... D32/58
4,923,156 A * 5/1990 Linneusson ..... F16M 11/242 248/170
4,989,123 A * 1/1991 Best ..... A45B 3/04 135/910
5,280,841 A * 1/1994 Van Deursen ..... D06F 57/04 211/189
5,449,075 A * 9/1995 Meade ..... D06F 57/04 211/167
5,819,961 A * 10/1998 Harris ..... A47G 25/0671 211/196
5,979,676 A * 11/1999 ster ..... A45B 25/14 135/22
7,025,215 B2 * 4/2006 Bain ..... A47G 25/16 248/150
7,077,276 B1 * 7/2006 Romano ..... D06F 57/04 211/205
7,775,382 B2 * 8/2010 Wuster ..... D06F 57/04 211/171
8,418,860 B2 * 4/2013 Rimmer ..... D06F 57/04 211/85.3
9,909,250 B1 * 3/2018 Greenspon ..... A47G 25/0685
2015/0083678 A1 * 3/2015 Baughman ..... A47F 5/04 211/85.3
2023/0190013 A1 * 6/2023 Hu ..... F16M 11/046 211/85.3

* cited by examiner

COLLAPSIBLE STAND ASSEMBLY FOR DRYING AND STORAGE

CROSS REFERENCE TO RELATED APPLICATIONS

This application claims priority from U.S. provisional application No. 63/516,051, filed Jul. 27, 2023, entitled "EQUIPMENT STAND ASSEMBLY", assigned to the present assignee and incorporated herein by reference.

FIELD OF THE INVENTION

The present invention relates to generally to equipment for storage and drying of clothes and accessories, and more particularly to a collapsible stand assembly for supporting clothes and accessories for drying and storage.

RELATED ART

In various sports disciplines such as hockey, football, and skiing, athletes utilize a diverse range of clothing and accessories for performance and protection. These garments and accessories frequently become wet due to external factors like rain or perspiration. Proper maintenance of these items is crucial, as storing them without adequate drying can lead to the growth of mold, mildew, and unpleasant odors, compromising their usability and longevity.

Existing solutions in the form of stands or racks are often ill-suited for the unique requirements of drying sports clothing and accessories. Their design limitations make them less effective in facilitating proper airflow and drying, which is vital for moisture removal and preventing mold and mildew.

Furthermore, these traditional stands and racks are typically tailored for specific types of clothing and accessories, lacking versatility in accommodating various sports gear. Their fixed construction often obstructs pathways when placed in a space, limiting flexibility in placement and usage. Additionally, their bulky and cumbersome nature makes them impractical for transportation, creating challenges for athletes who need to transport them over distances. This limitation restricts their mobility and convenience, particularly during competitions or training sessions away from home.

Accordingly, there exists a need for an improved solution that addresses the specific challenges associated with drying and storing sports clothing and accessories effectively, while also offering enhanced adaptability, space efficiency, and portability.

SUMMARY OF THE INVENTION

Illustrative embodiments provide a collapsible stand assembly for drying and storage of clothes, accessories and equipment. In one embodiment, a collapsible stand assembly includes an upper assembly and a lower assembly. The upper assembly is configured to be stacked above the lower assembly. A plurality of first arms extend outward from an upper frame of the upper assembly, and a plurality of second arms extend outward from a lower frame of the lower assembly. A plurality of legs extend outward from the lower frame of the lower assembly. The first and second arms and the legs are nested together in a stacked configuration. The first and second arms and the legs are collapsible into a compact configuration.

In an illustrative embodiment, the upper assembly includes a first hub which hingedly couples a plurality of support members to the upper frame. The first hub is in a sliding arrangement relative to the upper frame. The upper assembly includes a second hub which hingedly couples the first arms to the upper frame. The first hub selectively translates along the length of the upper frame to collapse or extend the first arms, and the second hub is securely coupled to a first end of the upper frame and is not configured to translate relative to the upper frame.

In an illustrative embodiment, the lower assembly includes a third hub which hingedly couples the legs to the lower frame. The third hub is in a sliding arrangement relative to the lower frame. The lower assembly includes a fourth hub which hingedly couples the second arms to the lower frame. The third hub selectively translates along the length of the lower frame to collapse or extend the legs, and the fourth hub is securely coupled to a first end of the lower frame and is not configured to translate relative to the lower frame.

In an illustrative embodiment, the first arms and the support members are pivotally coupled to each other, and the second arms and the legs are pivotally coupled to each other.

In an illustrative embodiment, a connector pipe is inserted into and affixed to an internal lower portion of the upper frame. The connector pipe is configured to translate within an upper portion of the lower frame. The connector pipe is configured to be inserted inside the lower frame to stack the upper assembly over the lower assembly.

In an illustrative embodiment, a collapsible stand assembly for drying and storage of clothes, accessories and equipment includes an upper assembly and a lower assembly. The upper assembly is stacked above the lower assembly. A plurality of first arms extend outward from an upper frame of the upper assembly, and a plurality of second arms extend outward from a lower frame of the lower assembly. A plurality of legs extend outward from the lower frame of the lower assembly. A first hub hingedly couples a plurality of support members to the upper frame. The first hub is in a sliding arrangement relative to the upper frame. A second hub hingedly couples the first arms to the upper frame. A third hub hingedly couples the legs to the lower frame. The third hub is in a sliding arrangement relative to the lower frame. A fourth hub hingedly coupling the second arms to the lower frame.

DESCRIPTION OF EXEMPLARY EMBODIMENTS

Figure 1:
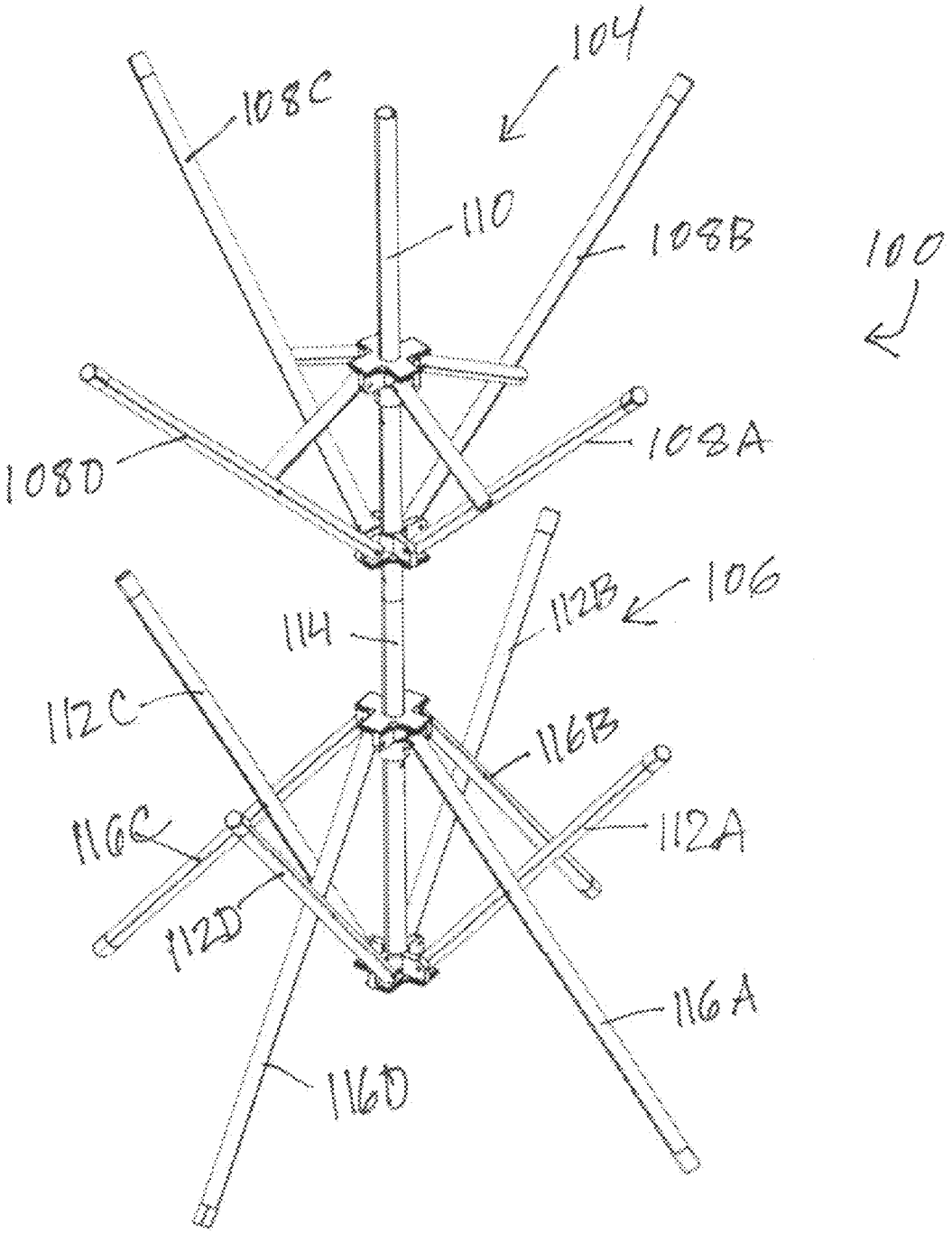
FIG. 1 depicts a collapsible stand assembly in accordance with an illustrative embodiment.

Illustrative embodiments are described below. It should be understood that various components, parts, and features of the different embodiments may be combined together and/or interchanged with one another, all of which are within the scope of the present application, even though not all variations and particular embodiments are shown in the drawings.

FIG. 1 depicts collapsible stand assembly 100 in accordance with an illustrative embodiment. Stand assembly 100 is configured for drying and storage of clothes, accessories and equipment. Stand assembly 100 provides a framework with upper and lower frames. A plurality of arms extend outward from the upper and lower frames. The arms are adaptable for holding various items such as sporting equipment, accessories, towels, and uniforms. The arms may be at different elevations or levels. The arms are nestled together in a stacked configuration. When not in use, the arms can be collapsed or folded into a compact configuration for storage.

In one embodiment, stand assembly 100 is a tree-like structure, where the multiple levels or tiers of arms extend outward from the upper and lower frames. The tree-like structure with multiple levels or tiers or arms enables stand assembly 100 to hold and support clothes, accessories and equipment for drying and storage. The arms are nestled together in a stacked configuration. Because the arms can be collapsed or folded into a compact package, the tree-like structure can be conveniently stored or transported.

In an illustrative embodiment, stand assembly 100 includes upper assembly 104 and lower assembly 106. Upper assembly 104 can be stacked above lower assembly 108. Upper assembly 104 includes a plurality of arms 108A-108D extending outward from upper frame 110. Although, upper assembly 104 is depicted as having four arms, upper assembly 104 can be configured to include more or fewer number of arms.

In some embodiments, arms 108A-108D extend outward, angling upward from upper frame 110. Upper frame 110 supports arms 108A-108D and provides stability to arms 108A-108D. Arms 108A-108D are configured to hold various items such as sporting equipment, accessories, towels and uniforms. Arms 108A-108D can be selectively collapsed or folded to reduce the spatial footprint and become less obstructive. Upper frame 110 supports the operation of arms 108A-108D.

Lower assembly 106 includes a plurality of arms 112A-112D extending outward from lower frame 114. In some embodiments, arms 112A-112D extend outward, angling upward from lower frame 110. Lower frame 114 supports arms 112A-112D and provides stability to arms 112A-112D. Arms 112A-112D can be selectively collapsed or folded to reduce the spatial footprint and become less obstructive.

Lower assembly 106 includes a plurality of legs 116A-116 extending outward from lower frame 114. Legs 116A-116D serve to support stand assembly 100 when it is placed on the ground. Angling downward from lower frame 114, legs 116A-116D provide stability to stand assembly 100, ensuring it remains vertically oriented. Although, lower assembly 106 is depicted as having four arms and four legs, lower assembly 106 can be configured to include more or fewer number of arms and legs. When upper assembly 104 is stacked above lower assembly 106, multiple levels or tiers of arms are provided to hold sporting equipment, accessories, towels, uniforms, or any other items for drying or storage.

Figure 2:
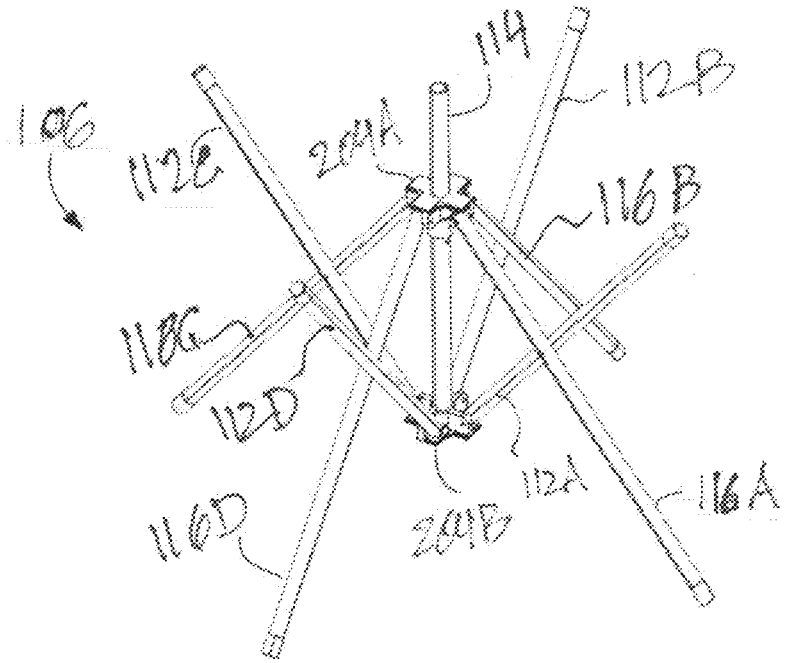
FIG. 2 depicts a lower assembly in accordance with an illustrative embodiment.

FIG. 2 depicts lower assembly 106 in accordance with an illustrative embodiment. Lower assembly 106 includes lower frame 114, opposing hubs 204A and 205B, arms 112A-112D and legs 116A-116D.

Hub 204A is hingedly coupled to legs 116A-116D. Hub 204A is in a sliding arrangement relative to lower frame 114. Hub 204A selectively translates along the length of lower frame 114 so as to collapse arms 112A-112D and legs 116A-116D inward or alternatively extend arms 112A-112D and legs 116A-116D outwardly. In FIG. 2, lower assembly 106 is shown in an extended orientation with arms 112A-112D and legs 116A-116D extended outwardly. Hub 204B hingedly couples arms 112A-112D to lower frame 114.

Arms 112A and legs 116A are also pivotally coupled to one another. In the illustrative embodiment, arm 112A is pivotally coupled to leg 116A, arm 112B is pivotally coupled to leg 116B, arm 112C is pivotally coupled to leg 116C, and arm 112D is pivotally coupled to leg 116D. As a result, if legs 116A-116D are collapsed or folded, arms 112A-112D also fold or collapse, and if legs 116A-116D are extended outward, arms 112A-112D also extend outward.

Hub 204B is securely coupled to a first end of lower frame 114. Hub 204B is not configured to translate relative to lower frame 114, and hub 204B is not in a sliding arrangement with lower frame 114.

Figure 3:
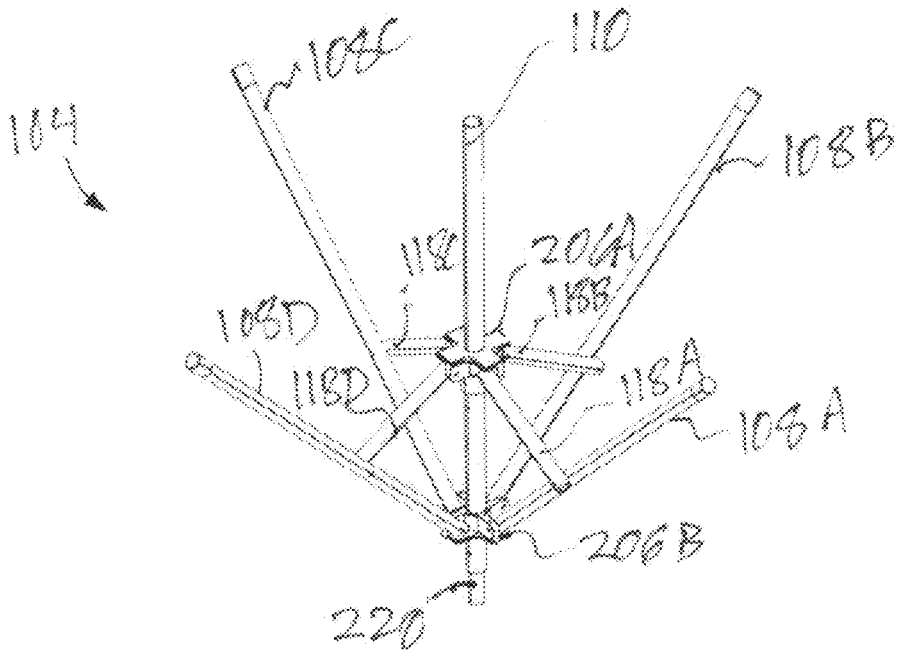
FIG. 3 depicts an upper assembly in accordance with an illustrative embodiment.

FIG. 3 depicts upper assembly 104 in accordance with an illustrative embodiment. Upper assembly 104 includes upper frame 110, opposing hubs 206A and 206B, arms 108A-108D and support members 118A-118D. Upper assembly 104 is similar in form and function to that of lower assembly 106. Hub 206B is affixed to upper frame 110. Hub 206A is configured to translate along upper frame 110. Thus, hub 206A is in a sliding arrangement relative to upper frame 110. Support members 118A-118D are hingedly coupled to hub 206A. Support members 118A-118D are also coupled to respective arms 108A-108D. Upper assembly 104 is configured to be stacked above lower assembly 106.

In an example embodiment, upper frame 110 and lower frame 114 are made using hollow pipes. Upper frame 110 includes connector pipe 220 inserted into and affixed to an internal lower portion of upper frame 110. Connector pipe 220 sticks out from the bottom of upper frame 110 and is configured to translate within an upper portion of lower frame 114. Connector pipe 220 is inserted inside lower frame 114 to stack upper assembly 104 over lower assembly 106.

Figure 4:
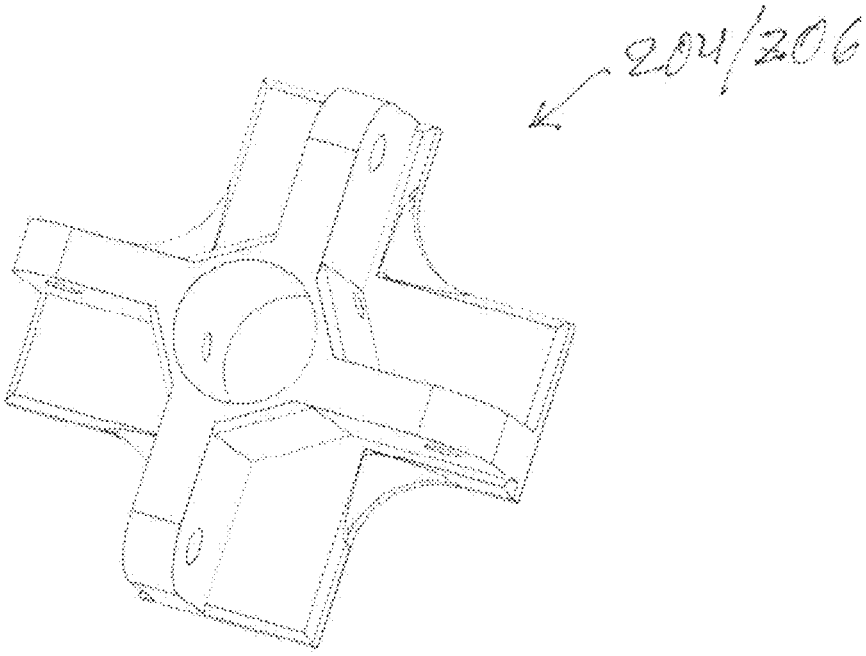
FIGS. 4-5 depict upper and lower perspective view of hubs in accordance with an illustrative embodiment.
Figure 5:
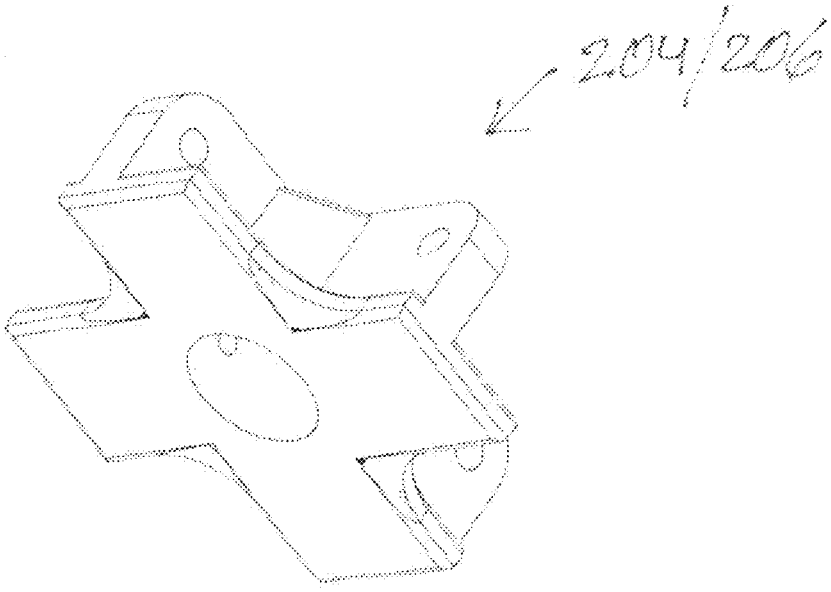

FIGS. 4-5 depict upper and lower perspective view of the hubs in accordance with an illustrative embodiment. The embodiment depicted is representative of hubs 204A-204D and 206A-206D. A plurality of notches in the hub bodies are made for the legs and arms to be attached thereto. A plurality of apertures are selectively positioned to permit hinged movement of the legs and arms. One or more apertures are included within a central main aperture to selectively permit affixing the hub to one of the central bodies.

Figure 6:
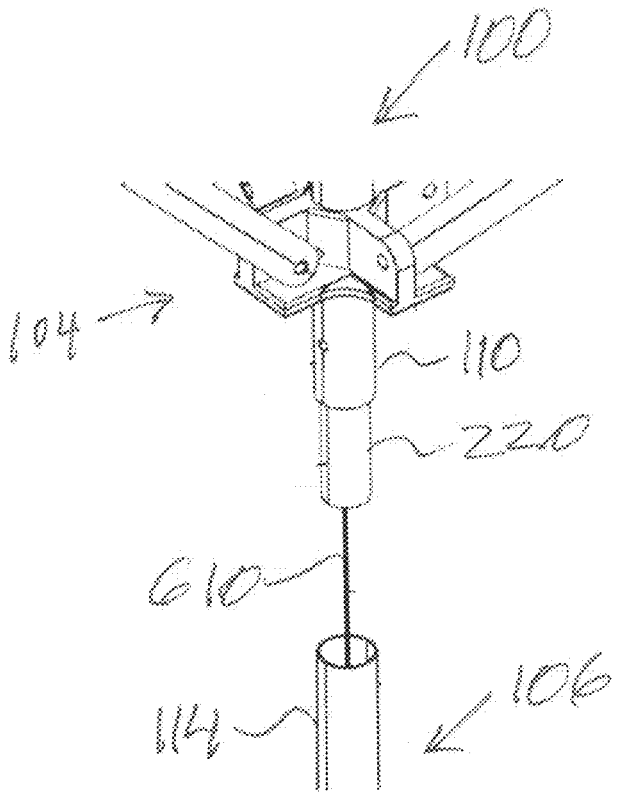
FIG. 6 illustrates a partially exploded view of the stand assembly.

FIG. 6 illustrates an enlarged view, partially exploded, of the stand assembly 100. Within this illustration, pipe 220 is depicted extending beneath upper frame 110, positioned for insertion into lower frame 114. Tether 610 is integrated internally within sections of both the upper frame 110 and lower frame 114. Tether 610 is designed with elastic properties, facilitating the maintenance of a compressive load between upper assembly 104 and lower assembly 106. This elastic tension serves to resist any tendency towards separation between the upper and lower assemblies.

Figure 7:
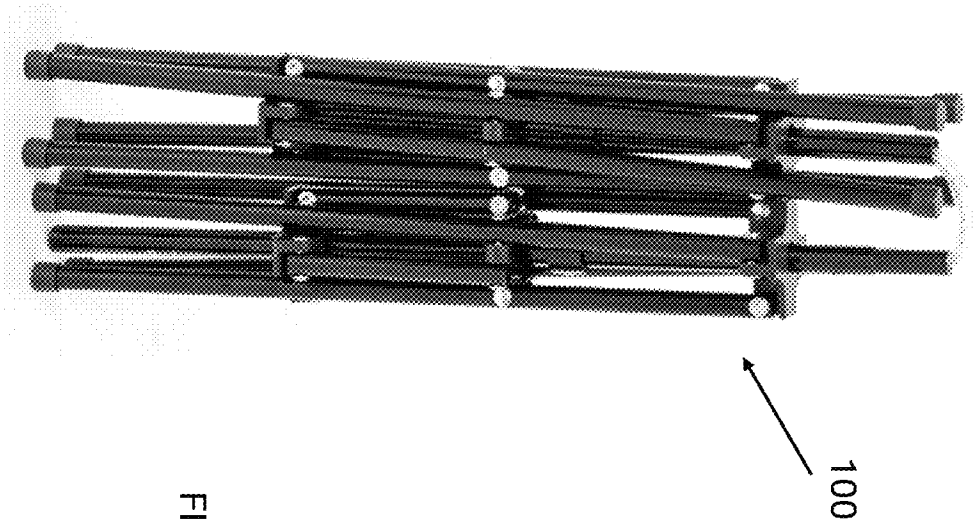
FIG. 7 illustrates the stand assembly configured in its collapsed state.

FIG. 7 illustrates stand assembly 100 configured in its collapsed state. Here, the legs and arms of both the upper and lower assemblies are folded adjacent to their respective frames. This collapse results in stand assembly 100 adopting a nested storage configuration, significantly reducing the amount of space required for storage purposes.

Variations to stand assembly 100 are possible and within the scope of the disclosure.

What is claimed is:

1. A collapsible stand assembly for drying and storage, comprising:

an upper assembly and a lower assembly, the upper assembly stacked above the lower assembly;

a plurality of first arms extending outward from an upper frame of the upper assembly;

a plurality of second arms extending outward from a lower frame of the lower assembly;

a plurality of legs extending outward from the lower frame of the lower assembly, wherein the first and second arms and the legs are collapsible into a compact configuration, wherein the second arms and the legs are pivotally coupled to each other.

2. The collapsible stand assembly of claim 1, wherein the upper assembly further comprises:

a first hub hingedly coupling a plurality of support members to the upper frame, the first hub in a sliding arrangement relative to the upper frame;

a second hub hingedly coupling the first arms to the upper frame, wherein the first hub selectively translates along the length of the upper frame to collapse or extend the first arms, and the second hub is securely coupled to a first end of the upper frame and is not configured to translate relative to the upper frame.

3. The collapsible stand assembly of claim 2, wherein the first arms and the support members are pivotally coupled to each other.

4. The collapsible stand assembly of claim 1, wherein the lower assembly further comprises:

a third hub hingedly coupling the legs to the lower frame, the third hub in a sliding arrangement relative to the lower frame;

a fourth hub hingedly coupling the second arms to the lower frame, wherein the third hub selectively translates along the length of the lower frame to collapse or extend the legs, and the fourth hub is securely coupled to a first end of the lower frame and is not configured to translate relative to the lower frame.

5. The collapsible stand assembly of claim 1, wherein collapsing or extending the legs causes in the corresponding folding or extension of the second arms.

6. The collapsible stand assembly of claim 1, wherein the first and second arms and the legs are nested together in a stacked configuration.

7. The collapsible stand assembly of claim 1, further comprising a connector pipe inserted into and affixed to an internal lower portion of the upper frame, wherein the connector pipe is configured to translate within an upper portion of the lower frame.

8. The collapsible stand assembly of claim 7, wherein the connector pipe is configured to be inserted inside the lower frame to stack the upper assembly over the lower assembly.

9. A collapsible stand assembly for drying and storage, comprising:

an upper assembly and a lower assembly, the upper assembly stacked above the lower assembly;

a plurality of first arms extending outward from an upper frame of the upper assembly;

a plurality of second arms extending outward from a lower frame of the lower assembly;

a plurality of legs extending outward from the lower frame of the lower assembly, a first hub hingedly coupling a plurality of support members to the upper frame, the first hub in a sliding arrangement relative to the upper frame;

a second hub hingedly coupling the first arms to the upper frame;

a third hub hingedly coupling the legs to the lower frame, the third hub in a sliding arrangement relative to the lower frame; and a fourth hub hingedly coupling the second arms to the lower frame, wherein the second arms and the legs are pivotally coupled to each other.

10. The collapsible stand assembly of claim 9, wherein the first hub selectively translates along the length of the upper frame to collapse or extend the first arms, and the second hub is securely coupled to a first end of the upper frame and is not configured to translate relative to the upper frame.

11. The collapsible stand assembly of claim 9, wherein the third hub selectively translates along the length of the lower frame to collapse or extend the legs, and the fourth hub is securely coupled to a first end of the lower frame and is not configured to translate relative to the lower frame.

12. The collapsible stand assembly of claim 9, wherein the first arms and the support members are pivotally coupled to each other.

13. The collapsible stand assembly of claim 9, further comprising a connector pipe inserted into and affixed to an internal lower portion of the upper frame, wherein the connector pipe is configured to translate within an upper portion of the lower frame.

14. The collapsible stand assembly of claim 9, wherein the connector pipe is configured to be inserted inside the lower frame to stack the upper assembly over the lower assembly.

15. A collapsible stand assembly for drying and storage, comprising:

an upper assembly and a lower assembly, the upper assembly stacked above the lower assembly;

a plurality of first arms extending outward from an upper frame of the upper assembly;

a plurality of second arms extending outward from a lower frame of the lower assembly;

a plurality of legs extending outward from the lower frame of the lower assembly, a first hub hingedly coupling a plurality of support members to the upper frame, the first hub in a sliding arrangement relative to the upper frame;

a second hub hingedly coupling the first arms to the upper frame, a third hub hingedly coupling the legs to the lower frame, the third hub in a sliding arrangement relative to the lower frame; and a fourth hub hingedly coupling the second arms to the lower frame, wherein the second arms and the legs are pivotally coupled to each other, and the first arms and the support members are pivotally coupled to each other.

16. The collapsible stand assembly of claim 15, wherein the first hub selectively translates along the length of the upper frame to collapse or extend the first arms, and the second hub is securely coupled to a first end of the upper frame and is not configured to translate relative to the lower frame.

17. The collapsible stand assembly of claim 15, wherein the third hub selectively translates along the length of the lower frame to collapse or extend the legs, and the fourth hub is securely coupled to a first end of the lower frame and is not configured to translate relative to the lower frame.

18. The collapsible stand assembly of claim 15, further comprising a connector pipe inserted into and affixed to an internal lower portion of the upper frame, wherein the connector pipe is configured to translate within an upper portion of the lower frame.

* * * * *